United States Patent [19]

Graf

[11] Patent Number: 4,854,012

[45] Date of Patent: Aug. 8, 1989

[54] SAW TOOTH WIRE OF A SAW TOOTH-CARD CLOTHING FOR A TEXTILE MACHINE PRODUCING RANDOMLY ORIENTED FIBRE FLEECES

[75] Inventor: Ralph A. Graf, Freienbach, Switzerland

[73] Assignee: Graf & Cie Ag, Rapperswil, Switzerland

[21] Appl. No.: 174,098

[22] Filed: Mar. 28, 1988

[30] Foreign Application Priority Data

Dec. 29, 1987 [EP] European Pat. Off. ..... 87119297.7

[51] Int. Cl.[4] ..... D01G 15/88

[52] U.S. Cl. ..... 19/114

[58] Field of Search ..... 19/113, 114

[56] References Cited

U.S. PATENT DOCUMENTS

| | | | |
|---|---|---|---|
| 795,946 | 8/1905 | Thielmann | 19/114 |
| 906,993 | 12/1908 | Bates et al. | 19/114 X |
| 2,340,069 | 1/1944 | McCarthy et al. | 19/114 X |
| 2,937,413 | 5/1960 | Hollingsworth | 19/114 |

FOREIGN PATENT DOCUMENTS

| | | | |
|---|---|---|---|
| 0138778 | 4/1985 | European Pat. Off. . | |
| 1927049 | 6/1970 | Fed. Rep. of Germany . | |
| 8531411 | 3/1987 | Fed. Rep. of Germany . | |
| 0612237 | 7/1926 | France | 19/114 |
| 2157330A | 10/1985 | United Kingdom . | |
| 2182612 | 5/1987 | United Kingdom . | |

*Primary Examiner*—Werner H. Schroeder

*Attorney, Agent, or Firm*—Ladas & Parry

[57] ABSTRACT

The teeth of the saw tooth wire of the card clothing are provided with a discontinuity. This discontinuity is located at the tip section of the teeth and at its trailing edge. The discontinuity forms an obstacle member retaining the fibers for a prolonged time on a corresponding drum of a textile machine. This leads to an improved random orientation of the fibres in the fibre fleece leading finally to a more stable non-woven product.

7 Claims, 1 Drawing Sheet

SAW TOOTH WIRE OF A SAW TOOTH-CARD CLOTHING FOR A TEXTILE MACHINE PRODUCING RANDOMLY ORIENTED FIBRE FLEECES

BACKGROUND OF THE INVENTION

1. Field of the Invention

The present invention relates to a saw tooth wire of a saw tooth card clothing of a textile machine for the production of a randomly oriented fibre fleece which saw tooth wire includes a plurality of saw teeth, each having a leading edge, a trailing edge and a saw tooth tip section located therebetween.

Randomly oriented fibre fleeces are utilized for the production of non-wovens. A procedure of producing such non-wovens is to double randomly oriented fleeces by serially arranged carding machines followed by a compressing by calenders leading to a consolidation of the fleeces. Thereby, the mutual adherance of the individual fibres is of utmost importance.

2. Description of the Prior Art

The U.K. patent specification GB-PS 2 147 018 discloses a textile machine for manufacturing a randomly oriented fibre fleece having a main cylinder and associated carding elements, a fibre feed-in-mechanism and a doffer roller adjacent the main cylinder. Additionally, there is provided an intermediate roller furnished with a card clothing and located close to the contacting area of the main cylinder and the doffer roller upstream of the fibre flow. The main cylinder and the intermediate roller rotate in the same direction and the intermediate roller rotates at a relatively high peripheral speed. In operation, the intermediate roller picks up fibres from the card clothing of the main cylinder and passes them on to the doffer roller. The fibres are centrifuged off by the centrifugal force of the main cylinder and are collected by the intermediate roller and accordingly get intensively tangled.

This known design requires, however, an increased expenditure regarding the mechanical drive relating to the intermediate roller, necessitates also an increased amount of card clothing and an increased power consumption.

SUMMARY OF THE INVENTION

Hence, it is a general object of the present invention to provide a saw tooth wire for a saw tooth card clothing which allows the production of a randomly oriented fibre fleece without the necessity of additional installations due to any working members between the main drum of a carding machine and its doffing roller.

A further object of the present invention is to provide a saw tooth wire for a saw tooth card clothing in which the saw tooth tip section comprises a fibre flow obstacle member operative to delay the sliding off of any fibres engaged by such tooth, whereby the delivery of the fibres from the main carding cylinder onto the doffer roller is delayed and an increased random orientation of the fibres in the fibre fleece produced thereby is attained.

During the carding of the fibres by the main carding cylinder the teeth of the card clothing engage the fibres which fibres are taken along by the card clothing teeth of the rotating main cylinder and finally taken up by the doffer roller whereby the fibres sort of slide off the teeth. Due to the obstacle member acting against the sliding off of the fibres their random orientation and mutual entanglement before and during the passing on to the doffer roller is much improved. This leads to an improved random orientation of the fibres in the fleece leading finally to an increased stability of the non-woven product manufactured.

BRIEF DESCRIPTION OF THE DRAWING

The invention will be better understood and objects other than those set forth above, will become apparent when consideration is given to the following detailed description thereof. Such description makes reference to the annexed drawings wherein:

FIG. 1 is a side view of a tooth of a saw tooth card clothing. Such card clothing is produced as a saw tooth wire which is wound around the cylinders, drums or rollers of a carding machine. In the present embodiments, this wire is intended to be wound around the main carding cylinder of a carding machine used in the production for non-woven products.

FIG. 1 illustrates a side view of one tooth of a saw tooth wire. In operation such tooth moves in the direction of the arrow "A", which direction is also applicable to FIGS. 2 and 3.

DESCRIPTION OF THE PREFERRED EMBODIMENTS

Figures 1, 2, 3, 4, 5:
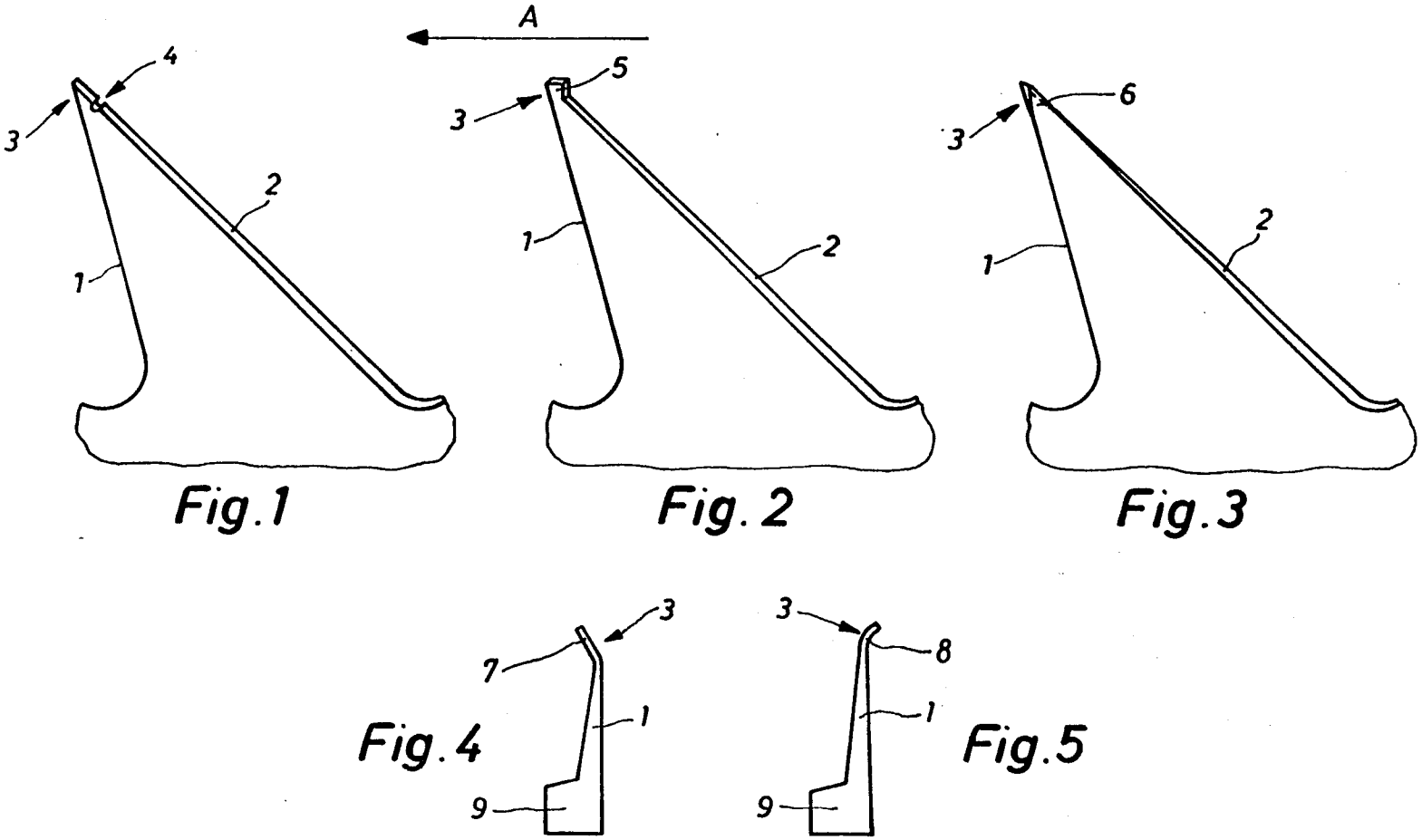
FIGS. 1–3 illustrate side views of a tooth of a saw tooth card clothing incorporating embodiments of the present invention.
FIGS. 4–5 illustrate front views of a tooth of a saw tooth card clothing incorporating further embodiments of the present invention.

The tooth has thus a leading edge 1 and a trailing edge 2, which edges meet at a saw tooth tip section 3.

A fibre flow obstacle member, a discontinuity in form of a recess 4 is located in the trailing edge 2 of the tooth. In operation the main carding cylinder rotates at a high speed, say 1000 rpm. and the teeth of the card clothing move circumferentially in the direction of the arrow "A". The incoming fibres will initally be engaged by the leading edge 11 and tangle around the respective teeth and will soon or later move towards the tooth tip either by centrifugal forces or by the action of other fibre flow controlling elements, may such be teeth of e.g. covers or of a doffer roller.

When a given fibre moves upwards along the tooth it will soon or later be caught in or at the discontinuity at the trailing edge 2, i.e. in the embodiment of FIG. 1 in the small recess 4. This delays the sliding-off movement of the fibre.

Conclusively, this fibre will remain somewhat longer on the main carding cylinder, i.e. during a higher number of revolutions in comparison with smooth edges, such that an increased tangling of the fibres is arrived at. When the fibres are finally slid off the main carding cylinder by the action of the working elements, e.g. teeth of the doffer roller their movement is somewhat acted against due to a part of the fibre being frictionally delayed due to the engagement with the recess 4, such that its orientation will enhance the tangling with other fibres leading to an increased random orientation. Because the recess 4 is at the trailing edge 2 of the tooth, no tearing of the fibre occurs, because the relative movement thereof onto the doffer roller is directed oppositely to the orientation of the arrow "A".

A further embodiment is illustrated in FIG. 2. The tip section 3 of the tooth is provided with a projection 5 at the trailing edge 2. This projection 5 0acts again as obstacle member, which delays the sliding off movement of the fibres from the tooth.

In the embodiment of FIG. 3 the saw tooth tip section 3 is twisted for forming an obstacle member. This twist again forms an obstacle against the unimpeded sliding-off movement of the fibres.

FIG. 4 illustrates a front view of a saw tooth of a further embodiment of the invention.

The tip section 3 is angled relative to the remainder of the tooth, having a bend such that a rectilinear obstacle member 7 extending obliquely is formed.

The reference numeral 9 denotes the foot of the tooth.

It is not important towards which side the tip section 3 is bent. A further embodiment comprises a curvilinearly extending tip section 8 forming a fibre flow obstacle member 6.

While there are shown and described present preferred embodiments of the invention, it is to be distinctly understood that the invention is not limited thereto, but may be otherwise variously embodied and practiced within the scope of the following claims.

I claim:

1. A saw tooth wire of a saw tooth card clothing of a textile machine for the production of a randomly oriented fibre fleece, which saw tooth wire includes a plurality of saw teeth, each having a leading edge, a trailing edge and a saw tooth tip section located therebetween, said saw tooth tip section comprising a fibre flow obstacle member, operative to delay the sliding-off of any fibres engaged by such tooth at the trailing edge thereof, whereby the delivery of the fibres from the main carding cylinder onto the doffer roller is delayed and an increased random orientation of the fibres in the fibre fleece produced thereby is attained.

2. The saw tooth wire of claim 1, in which said obstacle member comprises a discontinuity in the trailing edge of the saw tooth at its tip section.

3. The saw tooth wire of claim 2, in which said discontinuity is a recess in the trailing edge of the saw tooth at its tip section.

4. The saw tooth wire of claim 1, in which said obstacle member comprises a projection at the trailing edge of the saw tooth at its tip section.

5. The saw tooth wire of claim 1, in which said saw tooth tip section is twisted relative to the remainder of the tooth such to form the fibre flow obstacle member.

6. The saw tooth wire of claim 1, in which said saw tooth tip section is bent laterally such to extend at a lateral angle relative to the remainder of the tooth such to form the fibre flow obstacle member.

7. The saw tooth wire of claim 1, in which said saw tooth tip section extends laterally curvilinearly relative to the remainder of the tooth such to form the fibre flow obstacle member.

* * * * *